United States Patent [19]

Martini

[11] Patent Number: 4,881,303

[45] Date of Patent: Nov. 21, 1989

[54] QUICKLY ADJUSTABLE STIRRUP BUCKLE

[76] Inventor: M. Vey Martini, 14243 Oxford Dr., Laurel, Md. 20707

[21] Appl. No.: 311,859

[22] Filed: Feb. 17, 1989

[51] Int. Cl.[4] ..... A44B 11/12; B68C 1/20

[52] U.S. Cl. ..... 24/170; 24/191; 54/46

[58] Field of Search ..... 24/170, 191, 134 R, 24/179; 54/46

[56] References Cited

U.S. PATENT DOCUMENTS

| | | | |
|---|---|---|---|
| 13,778 | 7/1914 | Kerr | 54/46 |
| 330,213 | 11/1885 | Deweese . | |
| 351,788 | 11/1886 | McCord | 24/170 |
| 702,166 | 6/1902 | Wallace | 24/170 |
| 1,072,958 | 9/1913 | Kerr . | |
| 1,183,843 | 5/1916 | Badger . | |
| 1,194,699 | 8/1916 | Badger . | |
| 1,236,226 | 8/1917 | Stevenson, Jr. . | |
| 1,335,826 | 4/1920 | Faithfull . | |
| 3,253,309 | 5/1966 | Baresch | 24/170 |
| 3,413,691 | 12/1968 | Elsner | 24/170 |
| 3,641,739 | 2/1972 | Stubben . | |
| 3,678,542 | 7/1972 | Prete, Jr. | 24/170 |
| 4,205,416 | 6/1980 | Curtis | 24/191 |
| 4,567,628 | 2/1986 | Prete, Jr. et al. | 24/170 |

*Primary Examiner*—Victor N. Sakran

*Attorney, Agent, or Firm*—Richard C. Litman

[57] ABSTRACT

A quickly and easily adjustable buckle enables an equestrian to rapidly and precisely adjust the height of his or her stirrups relative to the saddle with less distraction than the equipment disclosed in the prior art. This provides a great advantage in many equestrian sports, in which it is desirable to rapidly transition from a "high iron" position in which the stirrups are raised, as during a race, to a "low iron" position in which the stirrups are lowered immediately after the horse has galloped. The rapidity, ease and precision with which the present invention enables these adjustments to be made greatly enhances the safety of both rider and horse during this critical phase.

3 Claims, 2 Drawing Sheets

QUICKLY ADJUSTABLE STIRRUP BUCKLE

FIELD OF THE INVENTION

The present invention relates to equipment used in the equestrian field, and more specifically to an improved stirrup apparatus for quickly and easily adjusting the length of the stirrups specific to the type of riding being done.

BACKGROUND OF THE INVENTION

At the present time, the stirrups are connected to the saddle by a standard buckle of the type normally found on a belt. This type of buckle consists of a U-shaped member through which a strap of leather is threaded. A pin is utilized such that it passes through a selected hole in the leather and rests upon the exposed portion of the U-shaped member. As one may imagine, such a design does not provide the rider the a simple means of adjusting the height of her/his stirrups quickly. She/he must release the pin from its present position, locate a new hole in the strap, and reattach the buckle securely. Following this, the rider has another stirrup to adjust in the same fashion, while the horse continues to misbehave underneath.

Clearly, the present system of adjustment does not allow for the rapid adjustment of the stirrups form the saddle necessary for a mounted rider whether it be in race riding, polo, horse shows, or recreational riding. In each of these sports, there exists a need for a stirrup arrangement that is quickly and easily adjusted to the proper height, or distance from the stirrup to the saddle. In other words, the closer the stirrup is to the saddle, the higher it is. Conversely, the more distant the stirrup is from the saddle, the lower it is.

Particular to the sport of race riding, the advantages of a quick and easily adjustable stirrup are considerable. In race riding, a rider needs to ride with shortened stirrups when the horse is galloping to insure the animal maximum freedom of movement. However, when the horse is expected to walk back to the stables, the rider needs to have the stirrups in a lowered position to have more "leg" around the horse's body thereby insuring a safer ride back to the stable.

If the rider is forced to maintain the high position of stirrups at the end of a gallop, she/he can be completely subject to the whim and will of the horse. The rider can have neither the balance to remain astride the horse, nor the ability to fully control the animal. The horse is suddenly in a position to act very independently to the will of the rider, because of the high position the rider's legs are in.

At this point, the rider and the horse are in a precarious situation. If the rider is thrown from the horse, she/he may suffer injuries related to impact with the ground. Additionally, the rider could risk injury while attempting to control the panicked animal from the ground, not to mention the damage a horse usually does to itself.

Under the present "belt buckel" system, the riders quickly remove their feet out of the stirrups and grip the body of the horse with their legs. At this point, the rider can only hope to remain seated on the horse, as long as the animal behaves, because the rider is at a distinct disadvantage due to loss of leverage. A rider's arms are not sufficiently strong enough to control a determined horse from wheeling, buckling, or lunging. He or she needs to have their feet firmly wedged in the lowered stirrups. To attempt this, without the leverage advantage of having their feet placed firmly in the "lowered stirrups", puts both the rider and the animal at a serious disadvantage.

Thoroughbreds represent the genes of hundreds of years of selective breeding. THe animal being ridden may be a champion racehorse in its own right, worth millions of dollars to the syndicate parent. The syndicate owner naturally wants to insure the animal's ultimate protection for useful lifespan as a racehorse, broodmare or stud prospect, show horse or polo pony, etc.

For these reasons, the many advantages to the horse, horse owner and the rider of a quickly adjustable stirrup buckle become evident. Following a gallop, the rider must immediately lower the stirrups safely. The problem has always been time. The quickly adjustable stirrup of the present invention is specifically designed to ensure the rider and horse the safest route possible from galloping to the stable by allowing the rider the control necessary in the shortest amount of time.

DESCRIPTON OF HTE RELATED ART

Many patents relating to such equipment have been issued in the past. Of particular significance in this regard are the following U.S. patents: U.S. Pat. No. 330,213 issued to L. L. Deweese on Nov. 10, 1885, U.S. Pat. No. 702,166 issued to J. H. Wallace on June 10, 1902, U.S. Pat. No. 1,072,958 issued to J. W. Kerr on Sept. 9, 1913, U.S. Pat. No. 1,183,843 issued to O. L. Badger on May 23, 1916, U.S. Pat. No. 1,194,699 issued to O. L. Badger on Aug. 15, 1916, U.S. Pat. No. 1,236,226 issued to H. L. Stevenson, Jr. on Aug. 7, 1917, U.S. Pat. No. 1,224,826 issued to W. L. F. Faithfull on Apr. 6, 1920, U.S. Pat. No. 3,253,309 issued to C. A. Baresch on May 31, 1966, U.S. Pat. No. 3,413,691 issued to E. C. Elsner on Dec. 3, 1968, and U.S. Pat. No. 3,641,739 issued to W. J. K. Stubben on Feb. 15, 1972.

Each of the aforementioned U.S. patents relates to the development of the standard buckle. It may be noted at this point that some of these patents do relate to th us of buckles in the specific manner as described herein. However, it is the novel combination of components comprising this invention which renders it novel over the prior art.

SUMMARY OF THE INVENTION

By the present invention, an improved buckle arrangement which allows the rider of a horse to quickly and easily adjust the height of the stirrups is provided.

Therefore, it is an object of the rpesent invention to provide a buckle arrangement which allows the rider to adjust the height of the stirrups quickly and safely, especially after completing the workout when it is desirable to "drop the irons" in order to maintain better control over the horse.

It is another object of the present invention to provide such a quickly adjustable buckle means that is of a low profile so as not to interfere with the rider and his/her movements while on the horse.

It is an additional object of the present invention to provide a buckle arrangement which may be easily and simply constructed and which eliminates the need to fabricate securing holes in the stirrup strap, thus reducing the strength of the strap.

It is a further object of the present invention to provide a buckle arrangement which may be adjusted to an infinite number of positions, rather than being limited to a relatively few positions.

With these and other objects in view which will more readily appear as the nature of the invention is better understood, th invention resides in the novel combination an arrangement of parts hereinafter more fully described and illustrated, with reference being made to the accompanying drawngs.

BRIEF DESCRIPTION OF THE DRAWINGS

Similar reference characters designate corresponding parts throughout the various figures of the drawings.

DESCRIPTION OF THE PREFERRED EMBODIMENT

Figure 1:
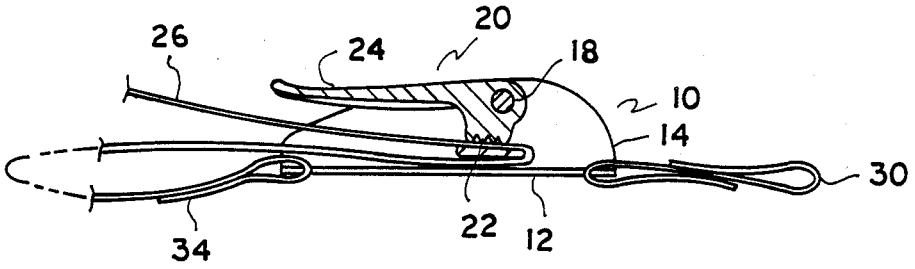
FIG. 1 is a cross sectional view of the buckle with the adjusting strap installed.

Referring now to the drawings, particularly FIG. 1, the present invention will be understood to relate to an arrangement for quickly and easily adjusting the height of stirrups relative to the saddle. The buckle 10 comprises a generally rectangular planar base portion 12 and upwardly extending side portions 14. Side portions 14 may be welded or otherwise securely attached to base 12, or may be formed of the same sheet of material as base 12 an bent upwardly into position. Side portions 14 serve to retain a wedge plate 16 and pin 18 in proper positon relative to each other. Pin 18 passes through a closely fitting hole in each side portion 14 and serves to retain latch means 20 in place.

Latch means 20 comprises a laterally ridged gripping member 22, fashioned in a manner similar to that of gear teeth, and actuating lever 24, which are formed as a single component and installed upon pin 18 so as to place gripping member 22 in close proximity to wedge plate 16. When lever 24 is lifted outward from base 12, gripping member 22 is also drawn away from plate 16, thus providing greater clearance therebetween for the adjustment of any strap 26 which may be installed therein. Latch means 20 is preferably equipped with a spring 28 in order to cam or bias the gripping surface 22 into the secured position of FIG. 1. Buckle assemble 10 is secured to a saddle S by means of an uppermost buckle strap 30 which passes through slot 32 of buckle assembly 10. A saddle skirt 11 normally overlies the uppermost buckle to protect the rider's thighs.

A unitary stirrup strap 26 forms a continuous length and includes a stirrup end 34 joined to a free handle end 36. Strap 26 will be seen to be fed through buckle assembly 10 with stirrup end 34 passing upward between base 12 and plate 16, around plat 16, and back over plate 16 with the handle end 36 passing between plate 16 and gripping means 22 and thence extending downwardly a substantial distance below the buckle 10.

Figure 2:
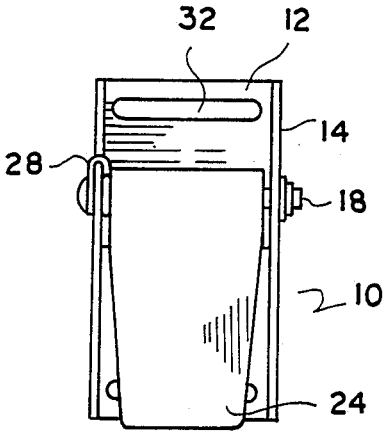
FIG. 2 is a top elevation illustration of the buckle as assembled.
Figure 3:
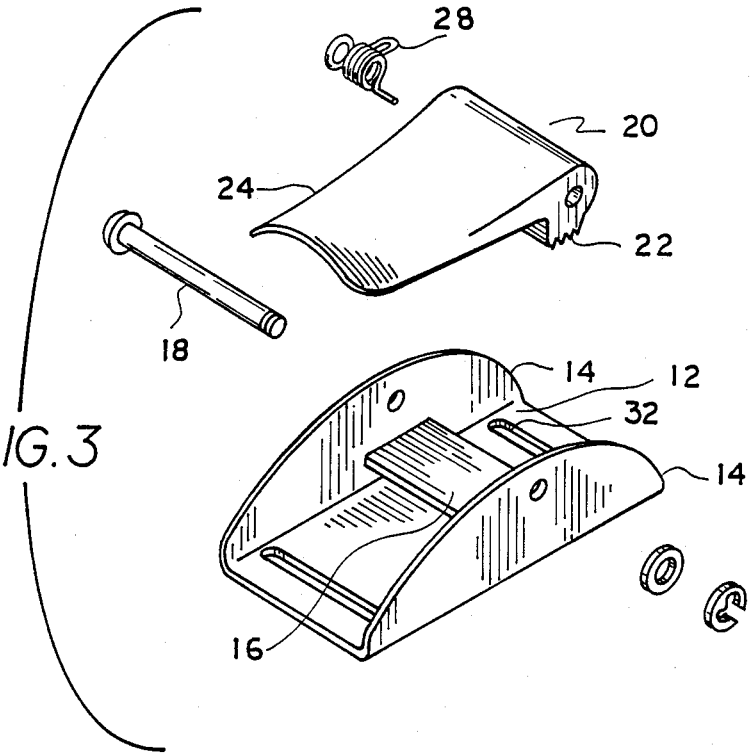
FIG. 3 is an exploded illustration of the buckle showing details of the various components of the buckle.
Figure 4:
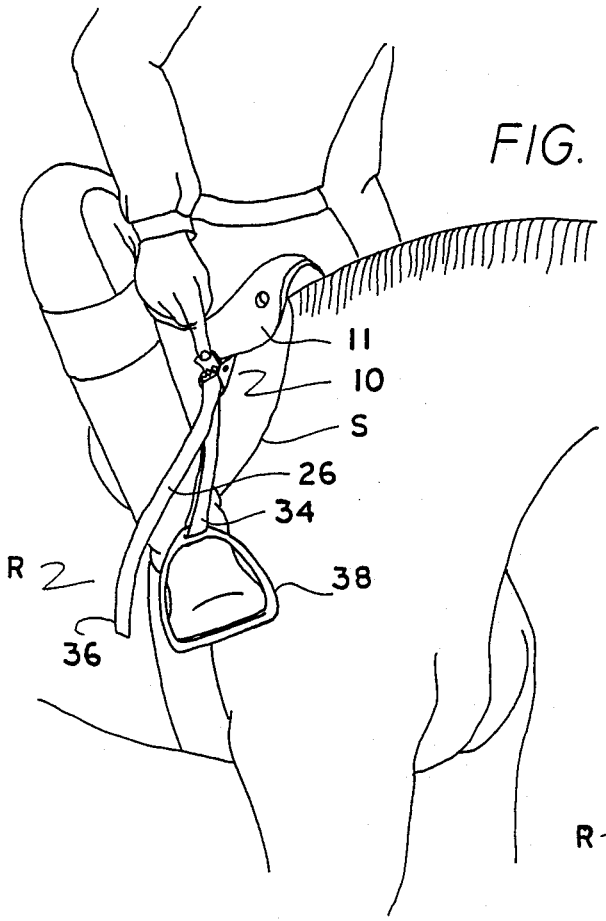
FIG. 4 is a partial perspective view of the rider adjusting the stirrup to a lower position.
Figure 5:
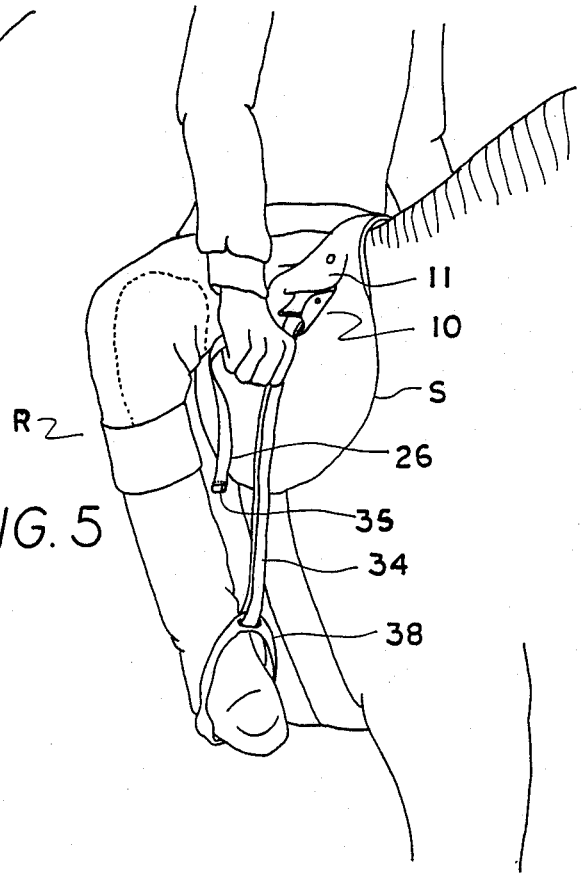
FIG. 5 is a partial perspective view of th rider adjusting the stirrup to a higher position.
Figure 6:
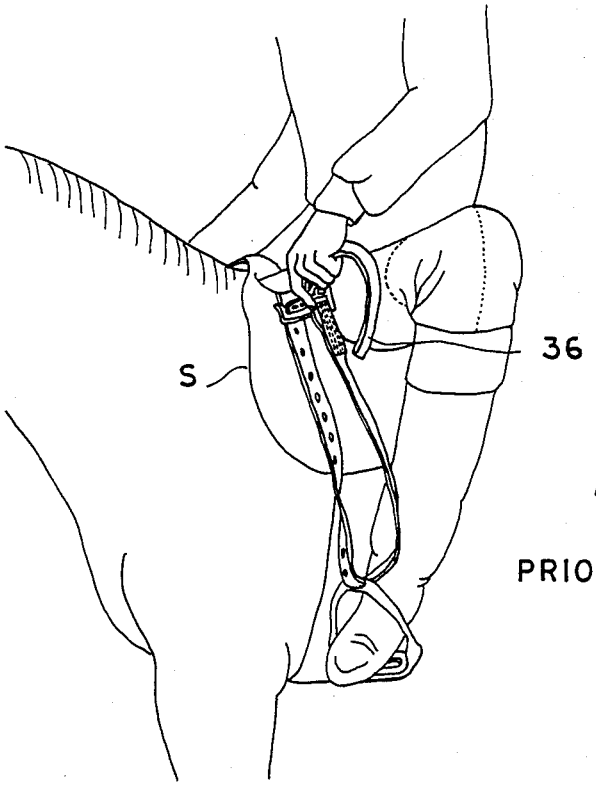
FIG. 6 PRIOR ART
FIG. 6 is a partial perspective view of the rider adjusting the stirrup using the buckle from th prior art. This illustration exemplifies the cumbersome nature of the prior art.

In FIGS. 2 and 3, the operation of buckle 10 may be more clearly seen in its embodiment for the quick adjustment of stirrup height. Stirrup 38 is suspended from stirrup end 34 of strap 26, which passes through buckle assembly 10.

Normally a rider R will provide weight in stirrups 38 in whichever position the stirrups 38 may be. Such weight will produce a downward force upon stirrup end 34 of strap 26, thereby pulling strap 26 taut over plate 16 an attempting to draw strap handle end 36 upwardly through the buckle assembly 10 between plate 16 and gripping means 22. As more weight is applied to stirrup 38, gripping mans 22 is drawn even more tightly toward plate 16 due to its engagement with the relatively pliable material of strap 26, thereby producing an ever more tightening security for strap 26.

In order to lengthen stirrup end 34, and thereby lower the height of stirrup 38, rider R need merely lift upward on lever 24, which disengages gripping means 22 from strap 26. The weight of the rider R in stirrup 38 will then cause strap 26 to be pulled through buckle assembly 10 to any desired new position of stirrup 38. Rider R may modulate the position of lever 24 to produce greater or lesser drag upon strap 26, thereby controlling the rate at which strap 26 passes through buckle assembly 10 and providing precise control over the new position of stirrup 38 as desired. Alternatively, a stop or limit member 35 may be affixed to the handle strap end 36 to automatically provide abutment means defining the length of the stirrup straps 34 when the irons are dropped as above.

Stirrup 38 may be easily raised merely by pulling downward upon the handle end 36 of strap 26. This maneuver will pull gripping means 22 in a direction causing a reduction of gripping power uponstrap 26, thereby allowing handle end 36 to be drawn through buckle assembly 10 until the desired higher position of stirrup 38 is reached. Upon releasing free end 36, strap 26 will initially tend to be drawn back through buckle assembly 10, thereby engaging gripping means 22 and drawing gripping means 22 more tightly into contact with strap 26 as it clamps strap 26 against plate 16, thus quickly securing strap 26 within buckle assembly 10. Thus, either left or right stirrup may be easily, quickly and precisely adjusted with a minimum of effort and/or distraction on the part of the rider, thereby insuring more precise control over the horse at all times.

It is to be understood that the present invention is not limited to the sole embodiment described above, but encompasses any and all embodiments within the scope of the following claims.

I claim:

1. A quickly adjustable stirrup buckle comprising:

a rectangular planar base portion;

said rectangular planar base portion having two vertical sides extending from the edges of said rectangular planar base portion;

said rectangular planar base portion having two parallel slots at the opposing longitudinal ends of said rectangular planar base portion, a buckle strap slot and a unitary stirrup strap slot;

wherein said buckle strap slot and said unitary stirrup strap slot being each threaded with a strap member, an uppermost buckle strap through said buckle strap slot and an unitary stirrup strap through said unitary stirrup strap slot;

said vertical sides having each an aperture allowing for the acceptance of an elongated cylindrical member connected therebetween;

said vertical sides having a rigid plate portion connected therebetween;

said cylindrical member being surrounded at least in part by a spring member enabling said cylindrical member to return to a fixed position when not forcibly moved;

said spring member being surrounded at least in part by a latch means having gripping means on the side of said latch means displaced next to said rigid plate portion;

said latch means being arcuately shaped;

whereby said unitary strap connecting to the topmost portion of the stirrup arrangement; and whereby said buckle strap connecting to the saddle proper.

2. A method of use for a quickly adjustable stirrup buckle according to claim 1 wherein raising said stirrup arrangement to a higher position relative to the previous position being accomplished according to the following steps:

applying a downward force on a free end of said unitary stirrup strap, forcibly moving said unitary stirrup strap by said downward force thereby releasing said gripping means from said unitary stirrup strap, providing for the continuous movement of said unitary stirrup strap by the released engagement of said gripping means resulting from said downward force until said stirrup arrangement reaches the appropriate height relative to said saddle proper, and stopping the application of said downward force to allow for said gripping means to engage said unitary stirrup strap and hold said unitary stirrup strap fixed in position.

3. A method of use for a quickly adjustable stirrup buckle according to Claim 1 wherein lowering said stirrup arrangement to a lower position relative to the previous position being accomplished according to the following steps:

applying an upward force on the underside of said latch means thereby releasing said gripping means from said unitary stirrup strap, applying downward pressure to said stirrup arrangement, forcibly moving said stirrup arrangement to a lower position through the application of downward pressure on said stirrup arrangement, said unitary stirrup strap adjusting accordingly, and releasing said latch means to allow said gripping means to fixedly engage said unitary stirrup strap and hold said unitary stirrup strap fixed in position.

* * * * *